US007137925B2

(12) United States Patent
Rozycki et al.

(10) Patent No.: US 7,137,925 B2
(45) Date of Patent: Nov. 21, 2006

(54) SNOWBOARD TRAINING DEVICE

(76) Inventors: Jeffrey Rozycki, 28 Croft Ct., Pawcatuck, CT (US) 06379; Jeff Thomas DeWeese, 8 Winding Brook Dr., Saratoga Springs, NY (US) 12866

( * ) Notice: Subject to any disclaimer, the term of this patent is extended or adjusted under 35 U.S.C. 154(b) by 16 days.

(21) Appl. No.: 10/707,719

(22) Filed: Jan. 6, 2004

(65) Prior Publication Data

US 2004/0171463 A1 Sep. 2, 2004

Related U.S. Application Data

(60) Provisional application No. 60/319,839, filed on Jan. 7, 2003.

(51) Int. Cl.
*A63B 22/00* (2006.01)
*A63B 69/18* (2006.01)

(52) U.S. Cl. ..... 482/51; 434/253

(58) Field of Classification Search ..... 482/51; 280/14.27, 14.28, 16, 606, 900, 809, 87.041, 280/14.21, 637, 14.22, 21.1; 434/253, 247
See application file for complete search history.

(56) References Cited

U.S. PATENT DOCUMENTS 212,946 A * 3/1879 Johnson ..... 482/117
1,535,391 A * 4/1925 Anderson ..... 482/117
5,013,034 A * 5/1991 March et al. ..... 482/115
6,102,428 A * 8/2000 Bobrowicz ..... 280/607
6,481,741 B1 * 11/2002 Porte ..... 280/609
6,502,850 B1 * 1/2003 Schaller et al. ..... 280/610
6,520,516 B1 * 2/2003 Favorito et al. ..... 280/87.042
6,634,657 B1 * 10/2003 Graham ..... 280/14.27
6,736,414 B1 * 5/2004 Farrally-Plourde ..... 280/16
6,805,364 B1 * 10/2004 McClure et al. ..... 280/14.28
6,808,183 B1 * 10/2004 Schaller et al. ..... 280/14.22
6,923,454 B1 * 8/2005 Drako ..... 280/14.24

* cited by examiner

*Primary Examiner*—Stephen R. Crow
*Assistant Examiner*—Tam Nguyen

(57) ABSTRACT

A device to assist a beginner in learning how to snowboard. The device connects to the top rear of the snowboard and consists of a base plate that connects to the snowboard, a rotational component that connects to the base plate and allows vertical and horizontal rotation, and a handle that connects to the rotational component on one end and is held by the instructor on the other end. The instructor skis behind the beginner and applies force to the handle which controls the speed, direction and edging of the snowboard, thereby assisting the beginner in learning how to snowboard.

3 Claims, 10 Drawing Sheets

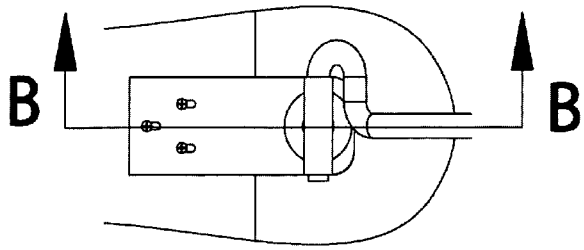
FIG. 6A
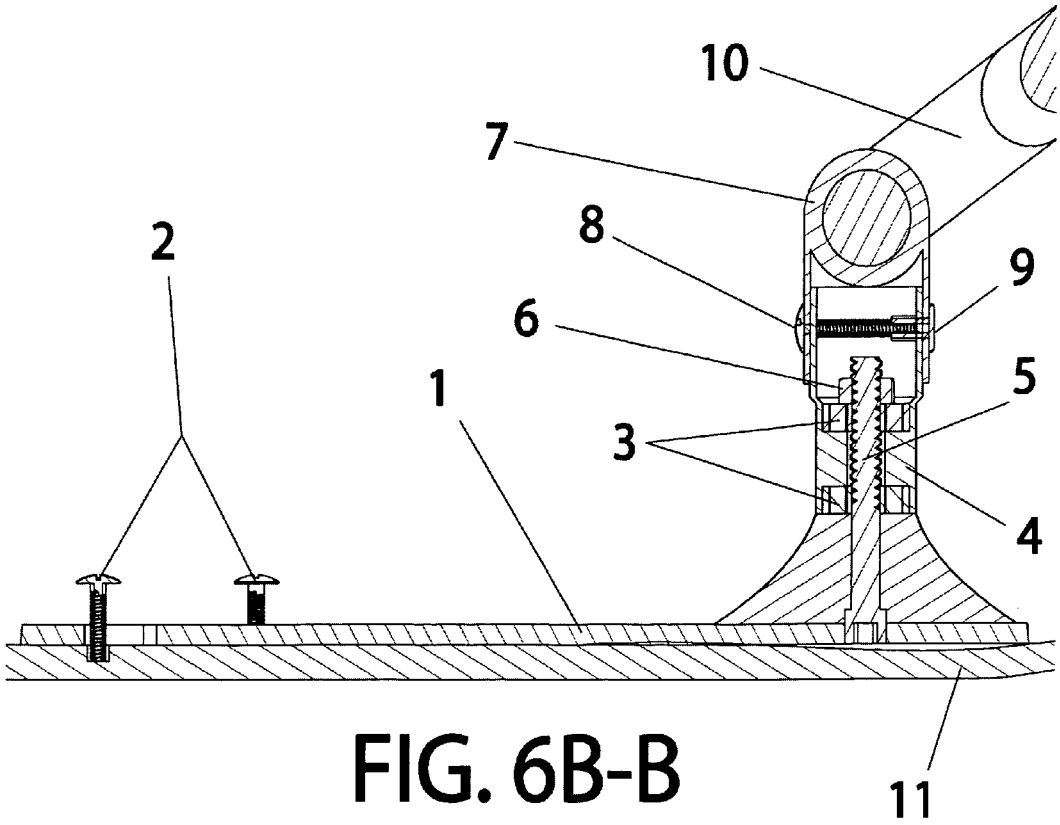
FIG. 6B-B

SNOWBOARD TRAINING DEVICE

CROSS REFERENCE TO RELATED APPLICATIONS

This application is a continuation to the provisional application No. 60/319,839 filed on Jan. 7, 2003.

SUMMARY OF INVENTION

The snowboard training device is a device that assists beginners in learning how to snowboard. The device connects to the top rear of the snowboard and extends a handle to an instructor which allows the instructor to ski behind the beginner to control the speed, direction, and edging of the snowboard.

Currently, most snowboard instructors walk or snowboard along the side of a beginner attempting to physically hold the beginner up in order to teach them the balance needed to control the snowboard. This typically results in the beginner and sometimes both the beginner and the instructor falling many times until the balance is learned. This method of instruction can be difficult since the instructor must run or snowboard after the beginner to catch up when the beginner starts moving on their own. This method of instruction is flawed in that the instructor is attempting to control the snowboard by means of holding onto the body of the beginner.

The snowboard training device allows the instructor to ski behind the beginner and control the snowboard by means of a handle and joint assembly that connects directly to the snowboard. The instructor is always connected to the beginner by holding on to the handle that connects to the beginner's snowboard. Therefore, the beginner cannot get away from the instructor. The instructor can control the speed of the beginner simply by slowing himself down while holding the handle that connects to the snowboard. The instructor can control the direction and edging of the snowboard by applying downward pressure to one end of the handle and upward pressure to the other end of the handle similar to what one would do to a steering wheel to control the direction of a car or the handle bars of a bike.

The handle can easily be attached to and unattached from the snowboard for loading the chair lift or other means of ascending the ski slope or transporting the snowboard. The instructor can also pull the beginner on flat or uphill terrain by having the beginner rotate the board 180 degrees, so that the snowboard training device is at the front of the snowboard, and pulling the handle.

DETAILED DESCRIPTION

Figure 1:
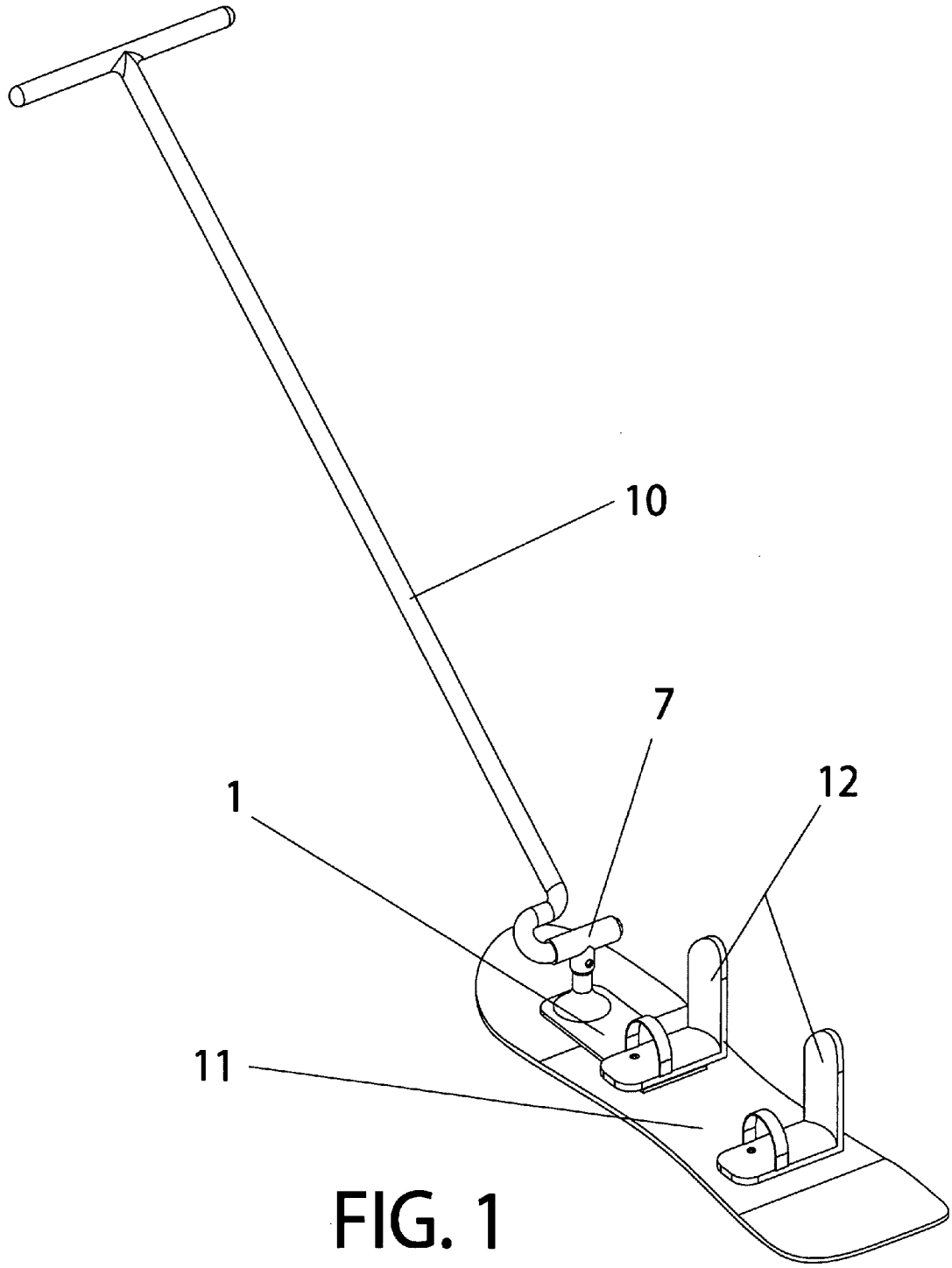
Figure 2:
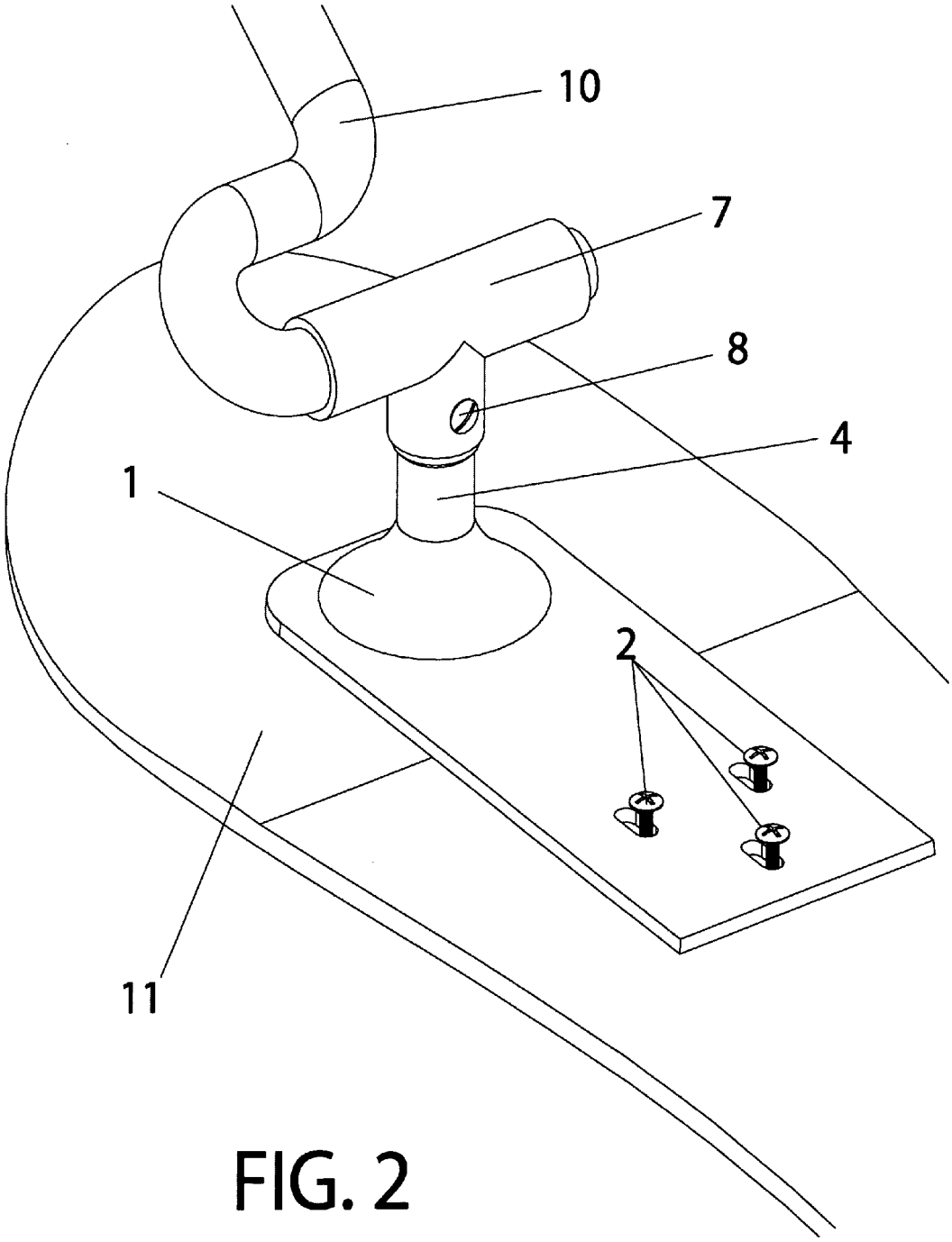
Figure 3:
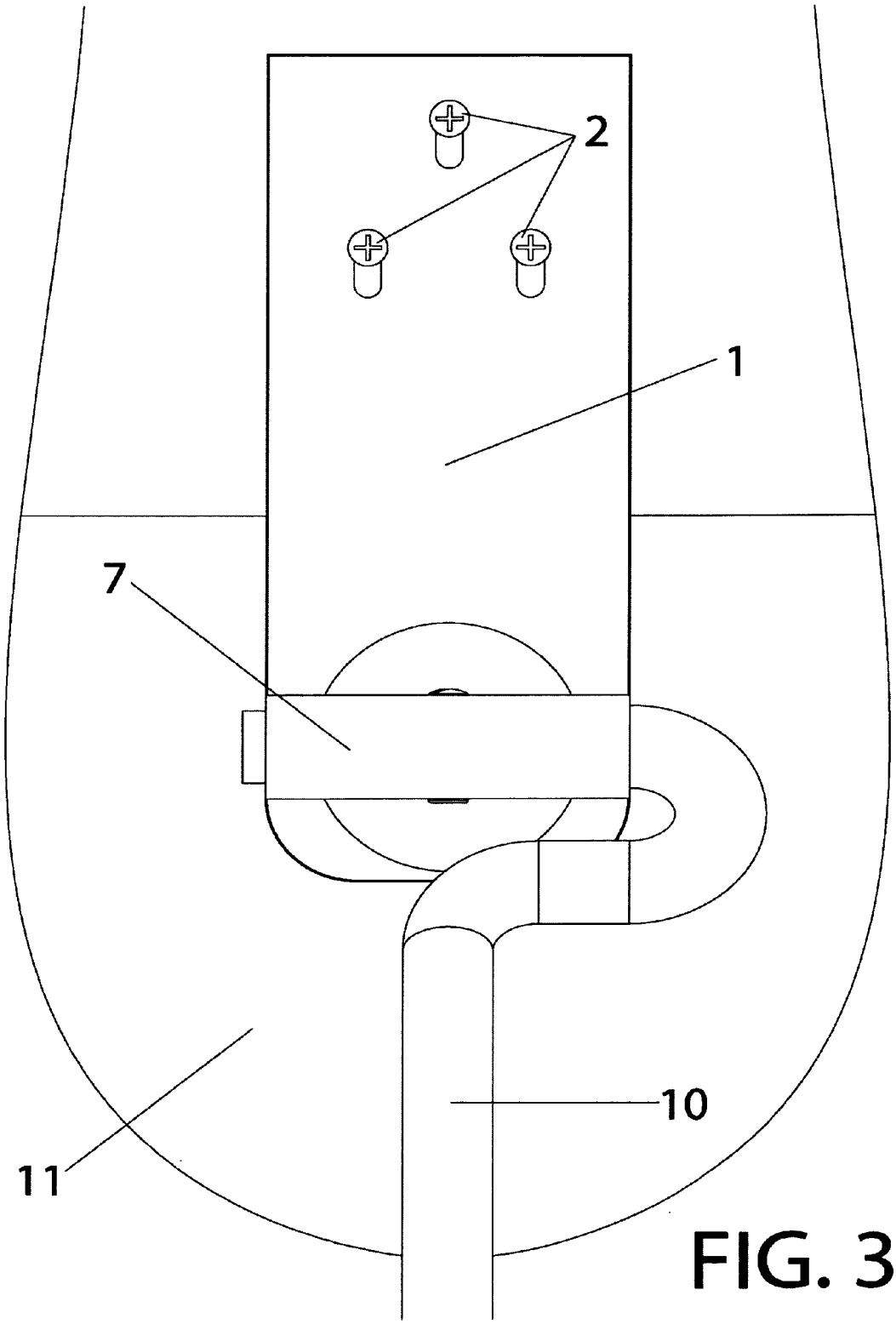
Figure 4:
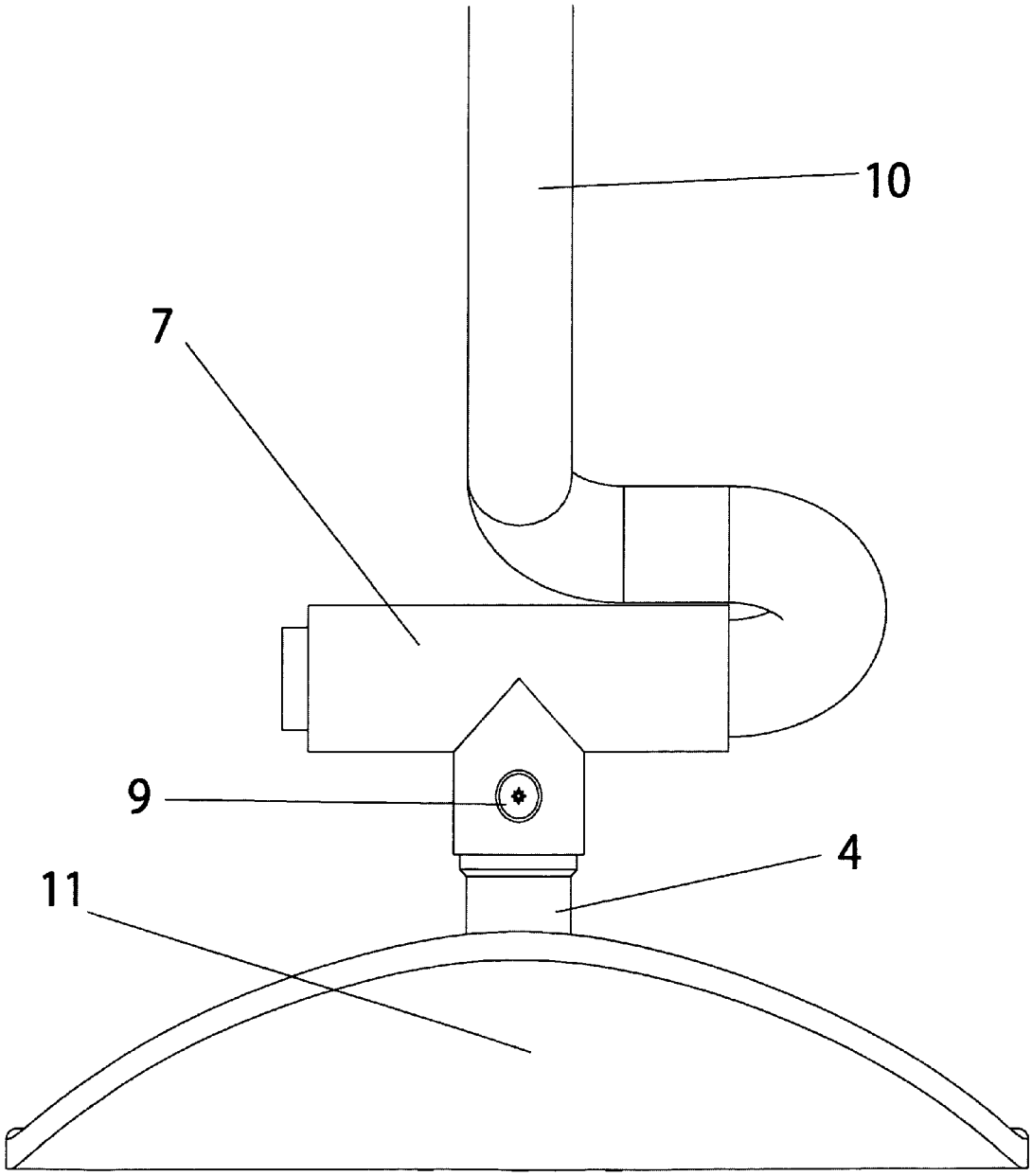
Figure 5:
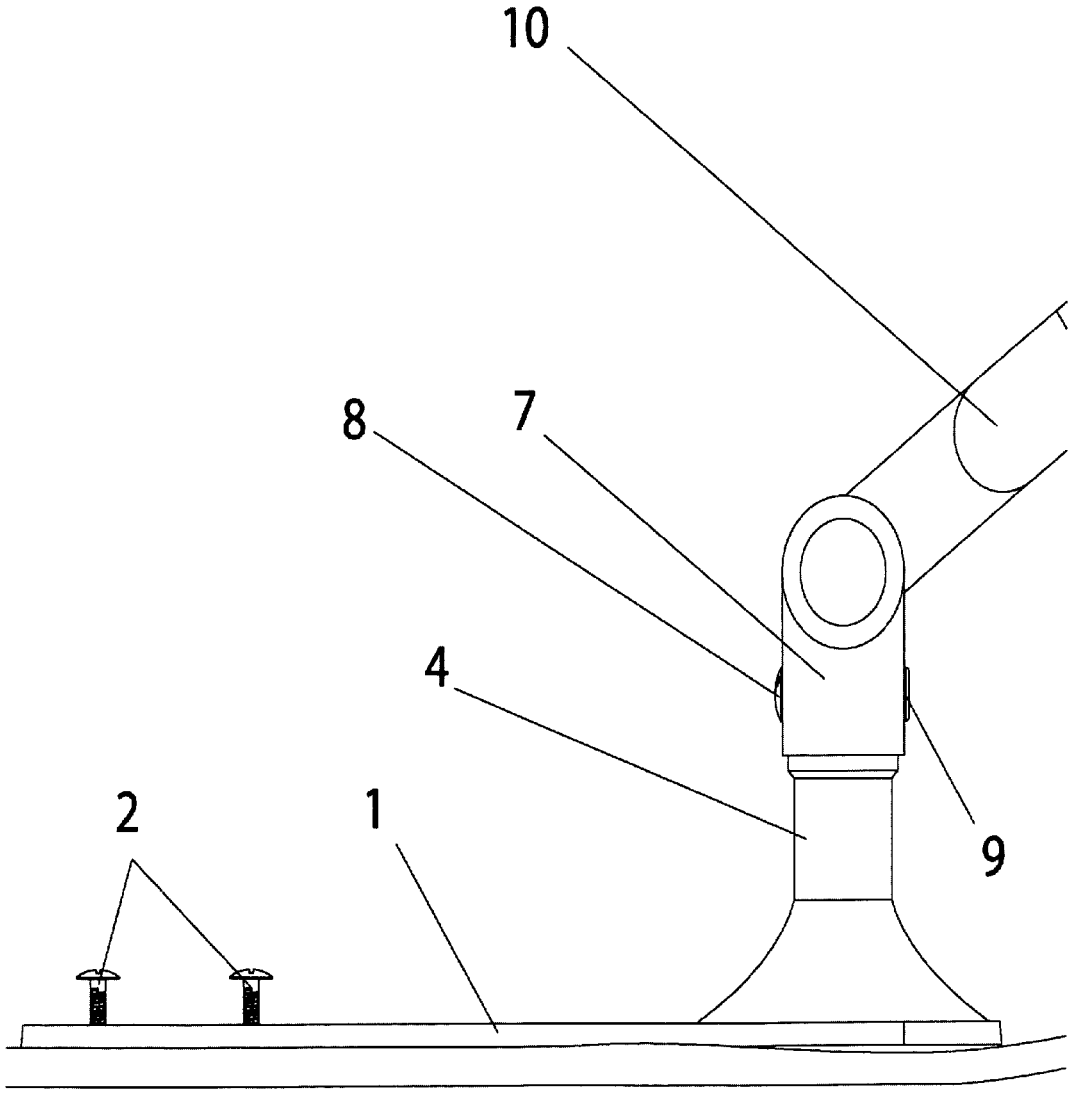
Figure 8A:
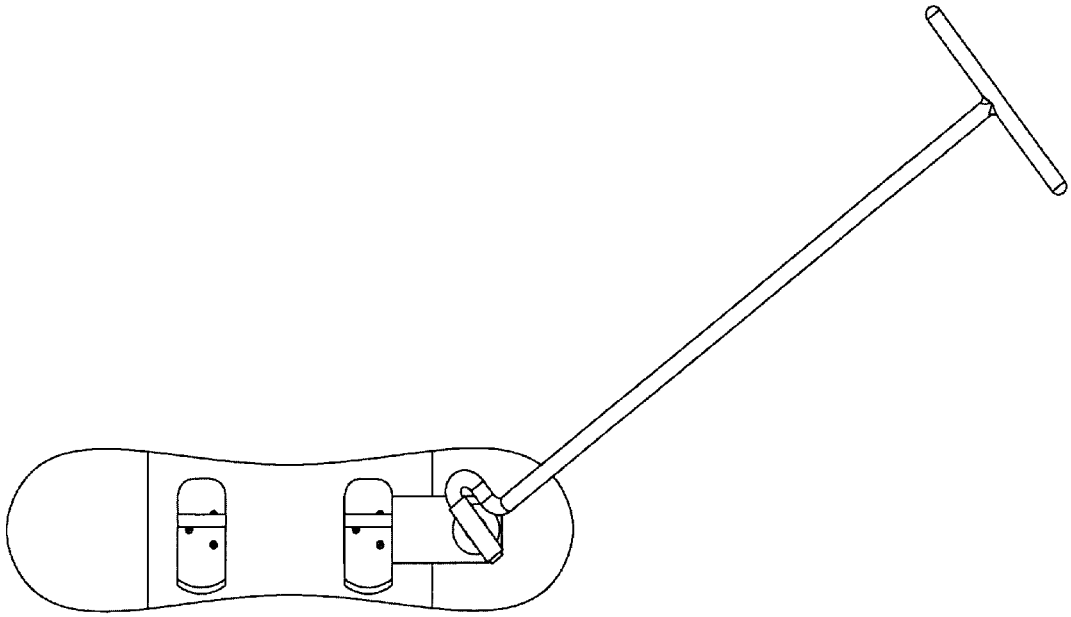
Figure 8B:
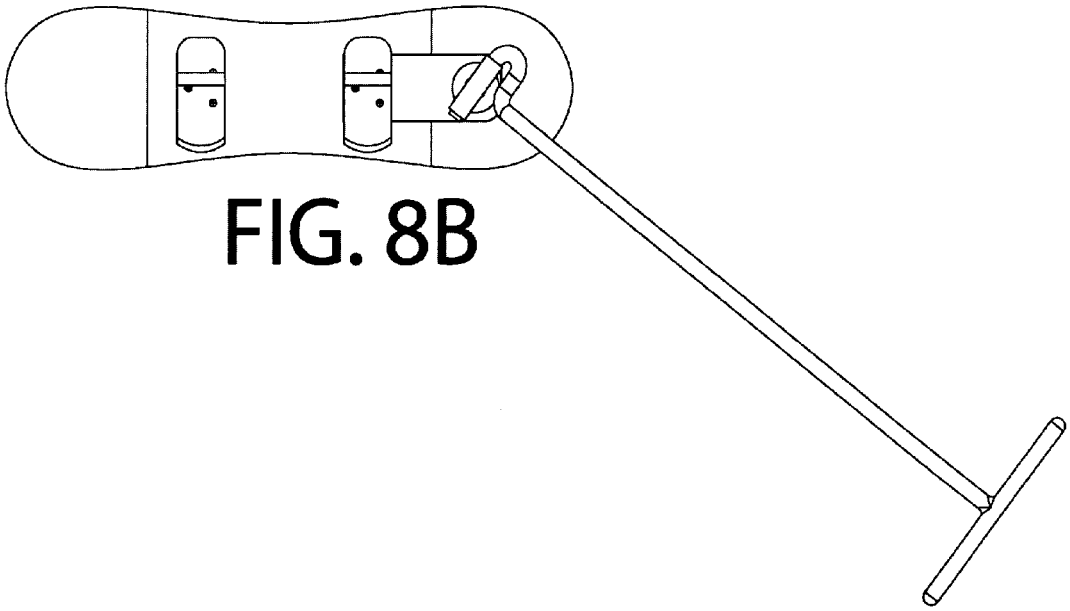

The snowboard training device (FIG. 1) is made up of three basic parts, the base plate (FIG. 1, Part 1), the swivel tee (FIG. 1, Part 7), and the handle (FIG. 1, Part 10) (Part 11 and 12 being the snowboard and snowboard binding, respectively). The base plate connects to the rear of the snowboard by means of the existing screw holes for the binding. The base plate has the same universal hole pattern as a standard binding so that it can be fitted onto any existing snowboard (FIG. 2). The binding is placed on top of the base plate and both the base plate and binding are affixed to the snowboard by the base plate attachment screws (FIG. 2, Part 2). Within the base plate is the bearing cup (FIG. 2, Part 4) which holds the bearings (FIGS. 6B–B, Part 3). The bearing cup is affixed to the base plate by means of the socket head bolt (FIGS. 6B–B, Part 5) and the socket head nut (FIGS. 6B–B, Part 6). The bearing cup provides connection to the swivel tee and allows rotation of the handle in the horizontal plane (FIGS. 8A and 8B).

Figure 7A:
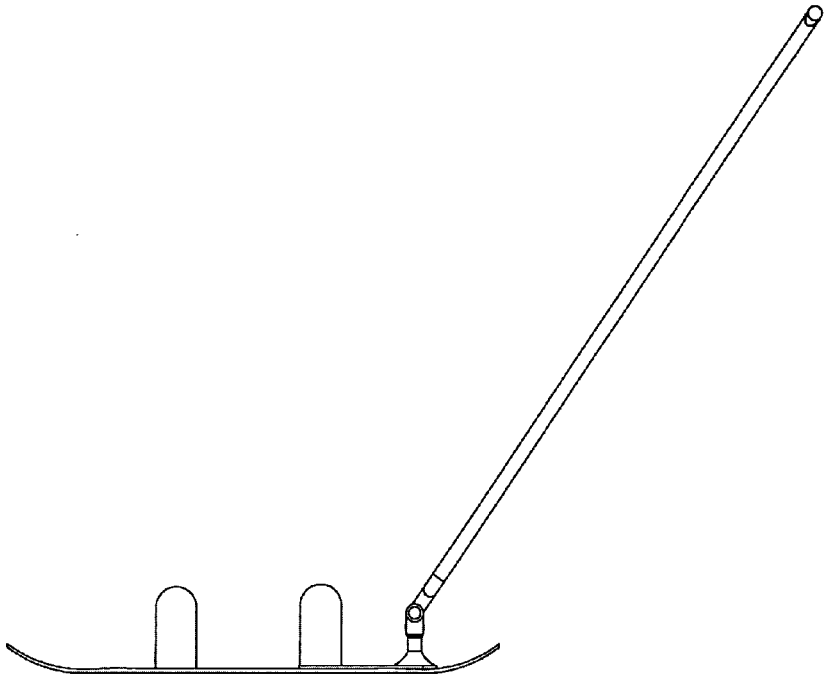
Figure 7B:
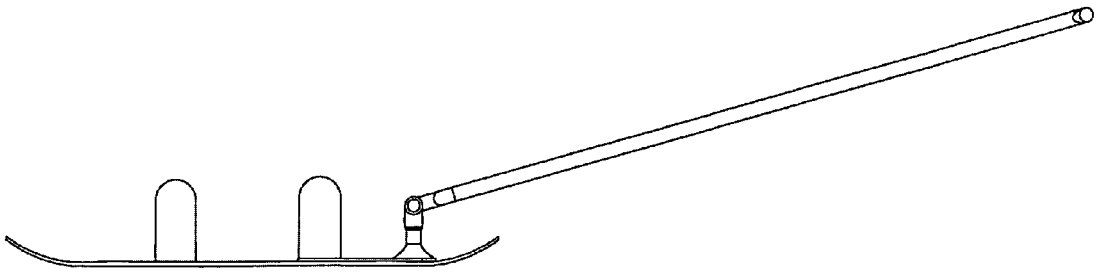

The swivel tee (FIG. 2, Part 7) connects to the bearing cup which is housed by the base plate on one end and connects to the handle on the other end. The swivel tee is affixed to the bearing cup by means of the Tbolt (FIGS. 6B–B, Part 8) and Tbolt nut (FIGS. 6B–B, Part 9). The handle can easily be removed from the swivel tee to allow loading onto the chair lift or other means of ascending the ski slope or transporting of the snowboard. The swivel tee allows rotation of the handle in the vertical plane (FIGS. 7A and 7B).

Figure 9:
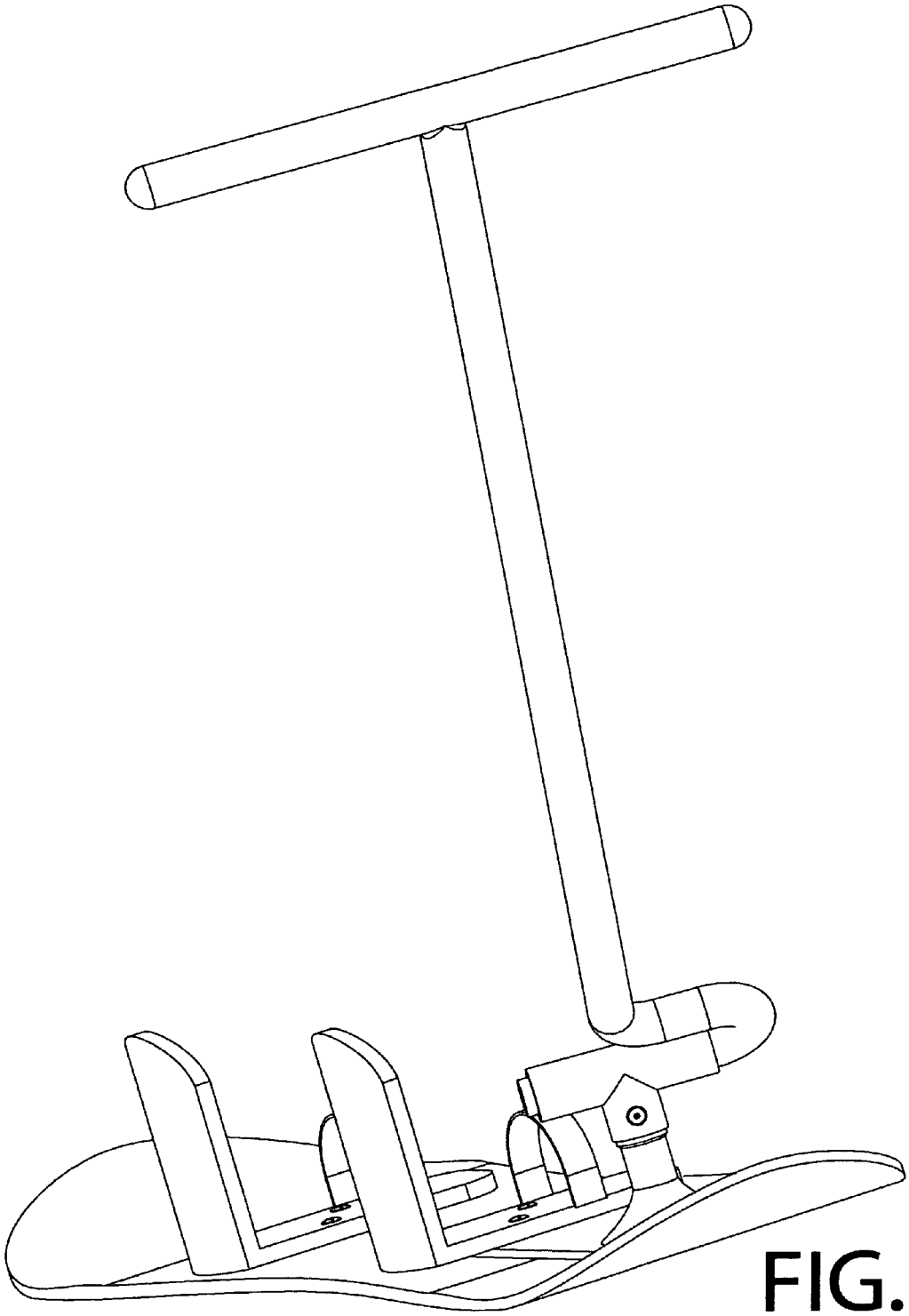
Figure 10:
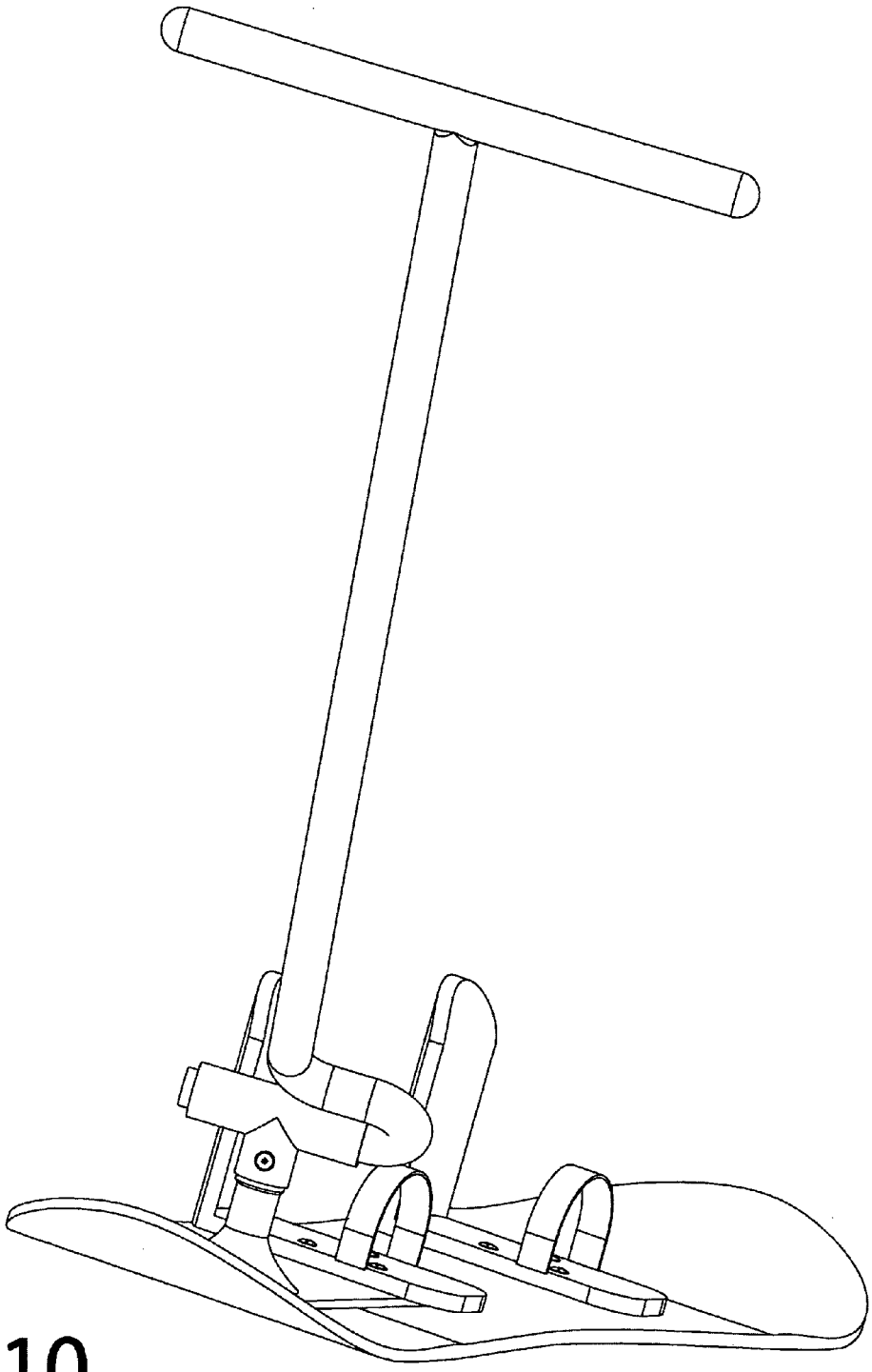

The handle (FIG. 2, Part 10) connects to the swivel tee on one end and is grasped by the instructor on the other end. The snowboard training device as a whole allows an instructor to apply a force and have that force transferred to the snowboard to control the direction and edging (FIG. 9 and FIG. 10) of the board. By grasping the handle and slowing or speeding himself, the instructor can control the speed of the snowboard.

The Invention claimed is:

1. A snowboarding training device that is removably attachable to a snowboard, the device consisting essentially of:

- a generally T-shaped handle having a first end and a second end, with a hand gripping portion on the first end of the handle and an elongated portion extending perpendicularly from the hand gripping portion;
- a universal connecting joint pivotally attached to the second end of the handle;
- a base plate having a pivot member for pivotally coupling the base to the universal connecting joint; and
- a means for attaching the base plate to a top rearward surface of a snowboard, such that when the training device has been attached to a snow board, a person skiing completely behind the snowboard can rotate the handle vertically and horizontally relative to the snow board to control the snowboard's direction, speed and edging so as to assist a student rider on the snowboard.

2. A device as defined in claim 1 wherein the means for attaching the base plate to the snowboard utilizes a set of existing binding screw holes located on the snowboard.

3. A device as defined in claim 1 wherein the handle is removably attached to the universal connecting joint and thus the snowboard.

* * * * *